US011617393B2

(12) United States Patent
Chen

(10) Patent No.: US 11,617,393 B2
(45) Date of Patent: Apr. 4, 2023

(54) ELECTRONIC ATOMIZING DEVICE AND ATOMIZER THEREOF

(71) Applicant: SHENZHEN SMOORE TECHNOLOGY LIMITED, Guangdong (CN)

(72) Inventor: Shouhao Chen, Guangdong (CN)

(73) Assignee: SHENZHEN SMOORE TECHNOLOGY LIMITED, Guangdong (CN)

( * ) Notice: Subject to any disclaimer, the term of this patent is extended or adjusted under 35 U.S.C. 154(b) by 431 days.

(21) Appl. No.: 16/920,441

(22) Filed: Jul. 3, 2020

(65) Prior Publication Data

US 2021/0000178 A1 Jan. 7, 2021

(30) Foreign Application Priority Data

Jul. 4, 2019 (CN) ..... 201921042335.4

(51) Int. Cl.
*A24F 40/42* (2020.01)
*A24F 40/40* (2020.01)
*A24F 40/46* (2020.01)

(52) U.S. Cl.
CPC ..... *A24F 40/42* (2020.01); *A24F 40/40* (2020.01); *A24F 40/46* (2020.01)

(58) Field of Classification Search
None
See application file for complete search history.

(56) References Cited

U.S. PATENT DOCUMENTS

2018/0271174 A1* 9/2018 Qiu ..... A24F 40/42
2020/0054073 A1* 2/2020 Qiu ..... A24F 40/49
2021/0000178 A1* 1/2021 Chen ..... A24F 40/485

OTHER PUBLICATIONS

"Office Action of Counterpart Canada Application No. 3,085,674", dated Mar. 17, 2022, p. 1-p. 7.

* cited by examiner

*Primary Examiner* — James Harvey
(74) *Attorney, Agent, or Firm* — JCIP Global Inc.

(57) ABSTRACT

The invention discloses an electronic atomizing device and an atomizer thereof. The atomizer includes a main body unit and a suction nozzle unit. The main body unit includes a liquid storage cavity, an atomization assembly fluidly connected to the liquid storage cavity and a first pipe fluidly connected to the atomization assembly. The liquid storage cavity includes a liquid injection port. The suction nozzle unit is detachably disposed on an upper end of the first pipe and seals the liquid injection port. The suction nozzle unit includes a second pipe, an operating member and an elastic member. The second pipe is detachably screwed to the first pipe and fluidly connected to the first pipe. The operating member is sleeved on the second pipe and axially movable relative to the second pipe between a first position and a second position, and rotatable around an axis of the second pipe.

20 Claims, 10 Drawing Sheets

ELECTRONIC ATOMIZING DEVICE AND ATOMIZER THEREOF

CROSS-REFERENCE TO RELATED APPLICATION

This application claims the priority benefit of China application serial no. 201921042335.4, filed on Jul. 4, 2019. The entirety of the above-mentioned patent application is hereby incorporated by reference herein and made a part of this specification.

BACKGROUND

Technical Field

The present invention relates to the field of atomizers, in particular to an electronic atomizing device and an atomizer thereof.

Description of Related Art

Electronic cigarettes are also known as virtual cigarettes or electronic atomizing devices. As substitutes for conventional cigarettes, the electronic cigarettes are often used for quitting smoking. With similar appearance and flavor to conventional cigarettes, the electronic cigarettes are generally free of harmful chemicals like tar in the cigarettes or aerosol.

Conventionally, an atomizer of the electronic cigarette in the related art is easy to be disassembled for refilling with liquid medium. If the atomizer is accidentally disassembled by a child, parts or liquid medium in the atomizer may be swallowed by the child by accident. Therefore, to prevent accidental swallowing by children, it is necessary to develop an electronic atomizing device to avoid being easily disassembled by children.

SUMMARY

In order to solve the above shortcomings in the prior art, the present invention provides an improved electronic atomizing device and an atomizer thereof.

In order to achieve the above objectives, the present invention provides an atomizer, including a main body unit and a suction nozzle unit, wherein the main body unit includes a liquid storage cavity, an atomization assembly fluidly connected to the liquid storage cavity, and a first pipe fluidly connected to the atomization assembly; the liquid storage cavity includes a liquid injection port fluidly connecting the liquid storage cavity with the outside; the suction nozzle unit is detachably disposed on an upper end of the first pipe, and seals the liquid injection port; the suction nozzle unit includes a second pipe, a cylindrical operating member and an elastic member; a lower end of the second pipe is detachably screwed to the upper end of the first pipe and is in fluid communication with the first pipe; the operating member is sleeved on the second pipe, and is able to axially move back and forth relative to the second pipe between a first position adjacent to the lower end of the second pipe and a second position away from the lower end of the second pipe, and to rotate around an axis of the second pipe; when the operating member is in the first position, the operating member cooperates with the second pipe to transmit a torsional force applied to the operating member by the outside to the second pipe; when the operating member is in the second position, the cooperation between the operating member and the second pipe is released; the elastic member is disposed between the second pipe and the operating member to elastically hold the operating member in the second position.

In some embodiments, the second pipe is provided with at least one limiting portion, and the operating member is provided with at least one clamping slot corresponding to the at least one limiting portion; when the operating member is in the first position, the at least one clamping slot is engaged with the at least one limiting portion; when the operating member is in the second position, the engagement between the at least one clamping slot and the at least one limiting portion is released.

In some embodiments, the second pipe includes a body portion, and the at least one limiting portion protrudes on a top surface of the body portion near an edge.

In some embodiments, the operating member includes a cylindrical operating body; the at least one clamping slot extends a distance upward from a lower end surface of the operating body; when the operating member is in the first position, a side wall surface of the at least one clamping slot corresponds to a side surface of the at least one limiting portion, so that when the operating member rotates, the side wall surface of the at least one clamping slot applies the torsional force to the side surface of the at least one limiting portion.

In some embodiments, the second pipe includes an upper pipe section disposed on a top surface of the body portion; an outer diameter of the upper pipe section is smaller than a diameter of the top surface of the body portion; the operating member includes a snap ring disposed on an upper end of the operating body; the snap ring is sleeved on the upper pipe section, and is able to axially move back and forth relative to the upper pipe section between the first position and the second position, and to rotate around an axis of the upper pipe section.

In some embodiments, the elastic member includes a cylindrical spring; the cylindrical spring is sleeved on the upper pipe section, with one end abutting against a bottom surface of the snap ring and another end abutting against the top surface of the body portion.

In some embodiments, the second pipe includes a body portion, a lower pipe section disposed on a bottom surface of the body portion and a skirt disposed on a periphery of the body portion and extending downward; the skirt and the lower pipe section define an annular receiving space; the suction nozzle unit further includes a sealing member received in the annular receiving space to seal the liquid injection port.

In some embodiments, the second pipe includes a body portion and a lower pipe section disposed on a bottom surface of the body portion; the lower pipe section is sleeved on an outer periphery of an upper end of the first pipe, and together with the upper end of the first pipe, defines a space for receiving a first sealing ring.

In some embodiments, the second pipe includes an upper pipe section disposed on a top surface of the body portion; an inner wall surface of a lower end portion of the upper pipe section is provided with an inner thread structure which is in threaded connection with an upper end of the first pipe.

In some embodiments, the main body unit includes a base and a cylindrical liquid storage shell disposed on the base via a bottom end thereof; the first pipe extends in the liquid storage shell, and is connected to the base via a lower end thereof, the lower end of the first pipe and the base clamp a lower end of the liquid storage shell to fix the liquid storage shell on the base; the atomization assembly is disposed in the first pipe; the liquid storage shell and the first pipe define the liquid storage cavity; the first pipe is provided with a liquid inlet hole for fluidly connecting the atomization assembly to the liquid storage cavity.

In some embodiments, the upper end of the first pipe protrudes from an upper end of the liquid storage shell, and is provided with an external thread structure on an outer wall surface thereof; a second sealing ring is provided at the upper end of the first pipe near the external thread structure.

The present invention further provides an electronic atomizing device, including the atomizer according to any one of the above.

The present invention has the beneficial effect that with the operating member and the elastic member in the atomizer, the operating member is normally in an idling state, so that the applied torsional force cannot be transmitted to the suction nozzle unit that seals the liquid injection port, thereby increasing the difficulty of disassembling the suction nozzle unit, and preventing children from disassembling the oil injection port at will.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

In order to help understand the present invention more clearly, the present invention is described in further detail below with reference to the accompanying drawings.

It should be understood that the terms "front", "back", "left", "right", "upper", "lower", "first" and "second" are merely intended to describe the technical solutions of the present invention conveniently, rather than to specify a special difference of the device or element referred to. Therefore, these terms should not be construed as a limitation to the present invention. It should be noted that when a component is "connected" to another component, the component may be connected to another component directly, or indirectly via an intermediate component. Unless otherwise defined, all technical and scientific terms used herein have the same meaning as those commonly understood by a person of skill in the art. The terms used herein are merely intended to describe the specific embodiments, rather than to limit the present invention.

Figure 1:
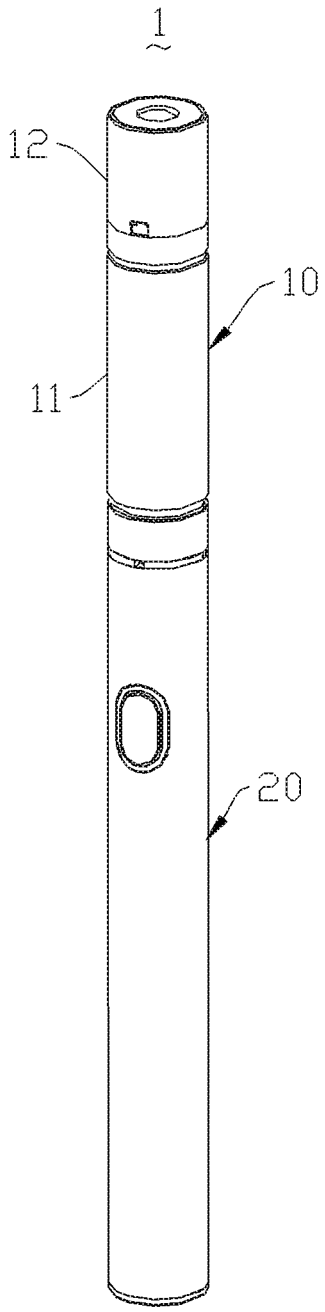
FIG. 1 is a three-dimensional structural view of an electronic atomizing device in some embodiments of the present invention.
Figure 2:
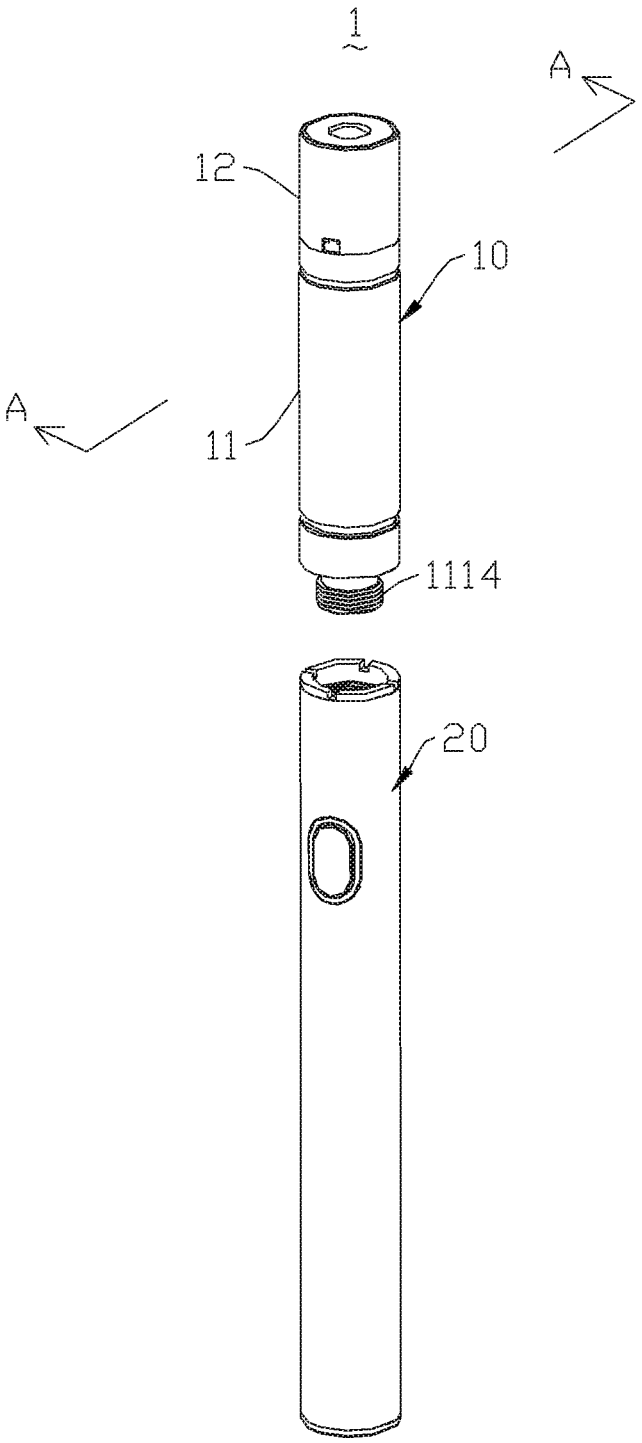
FIG. 2 is a three-dimensional exploded view of the electronic atomizing device shown in FIG. 1.

FIGS. 1 and 2 show an electronic atomizing device 1 in some embodiments of the present invention. The electronic atomizing device 1 can be used to heat and atomize a liquid medium such as a smoke liquid or medicinal liquid. The electronic atomizing device 1 may generally be cylindrical and include a cylindrical atomizer 10 and a cylindrical power supply device 20 axially detachably connected to the atomizer 10. The atomizer 10 is used to receive the liquid medium, heat and atomize the liquid medium, and deliver aerosol. The power supply device 20 is used to supply power to the atomizer 10 and control the operations of the entire electronic atomizing device 1 such as turning on or off.

Figure 3:
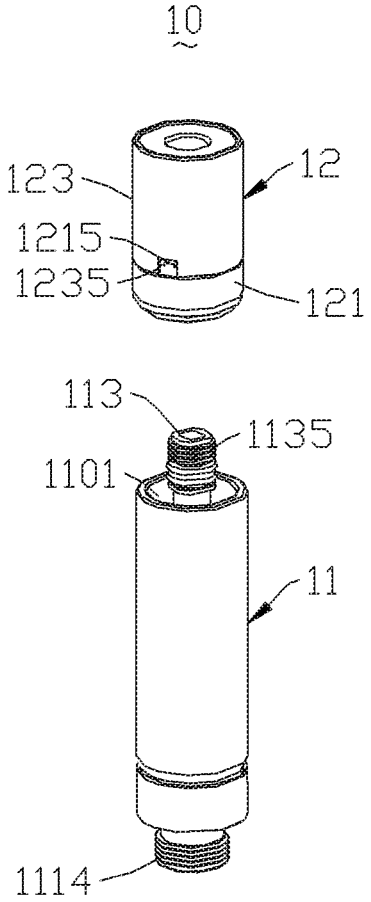
FIG. 3 is a three-dimensional exploded view of an atomizer of the electronic atomizing device shown in FIG. 2.
Figure 4:
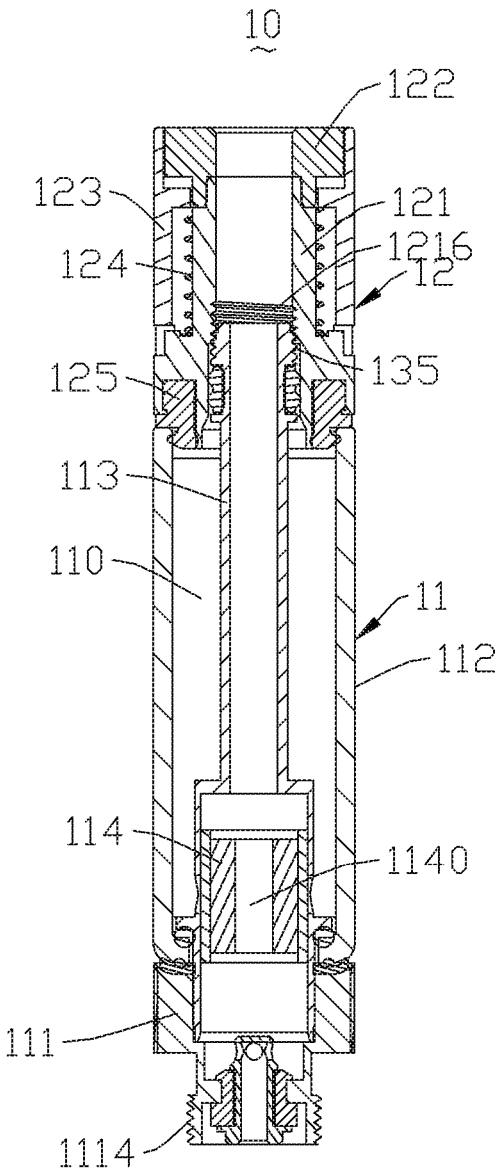
FIG. 4 is a sectional view A-A of the atomizer of the electronic atomizing device shown in FIG. 2.

As shown in FIGS. 3 and 4, in some embodiments, the atomizer 10 may include a main body unit 11 and a suction nozzle unit 12. The main body unit 11 is configured to be detachably connected to the power supply device 20 and includes a liquid storage cavity 110 for receiving the liquid medium and a liquid injection port 1101 fluidly connected to the liquid storage cavity 110. The suction nozzle unit 12 is detachably disposed on an upper end of the main body unit 11, and blocks the liquid injection port 1101. The main body unit 11 is used to heat and atomize the liquid medium and deliver the aerosol out of the main body unit 11. The suction nozzle unit 12 is used to discharge the aerosol generated in the main body unit 11.

Figure 5:
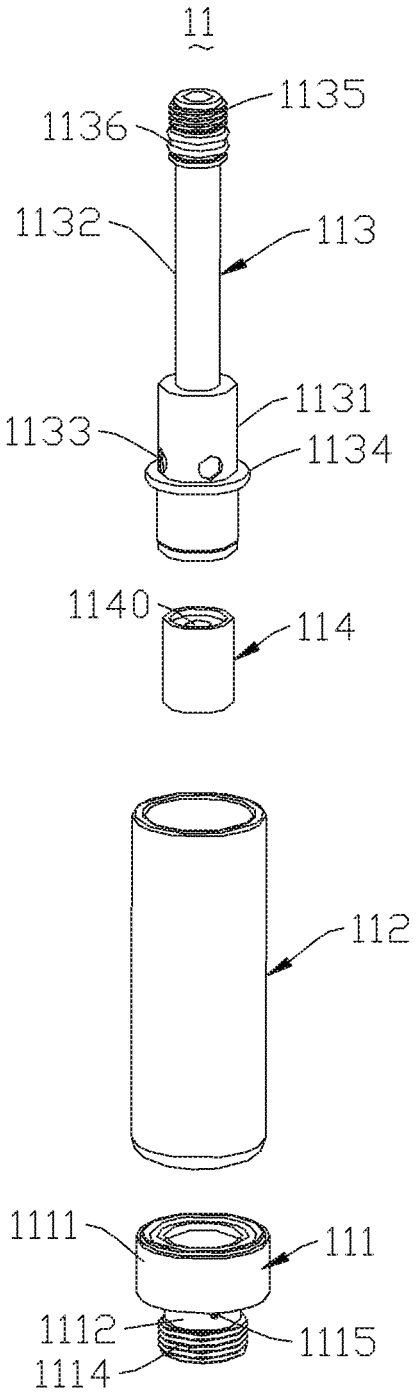
FIG. 5 is a three-dimensional exploded view of a main body unit of the atomizer shown in FIG. 3.
Figure 6:
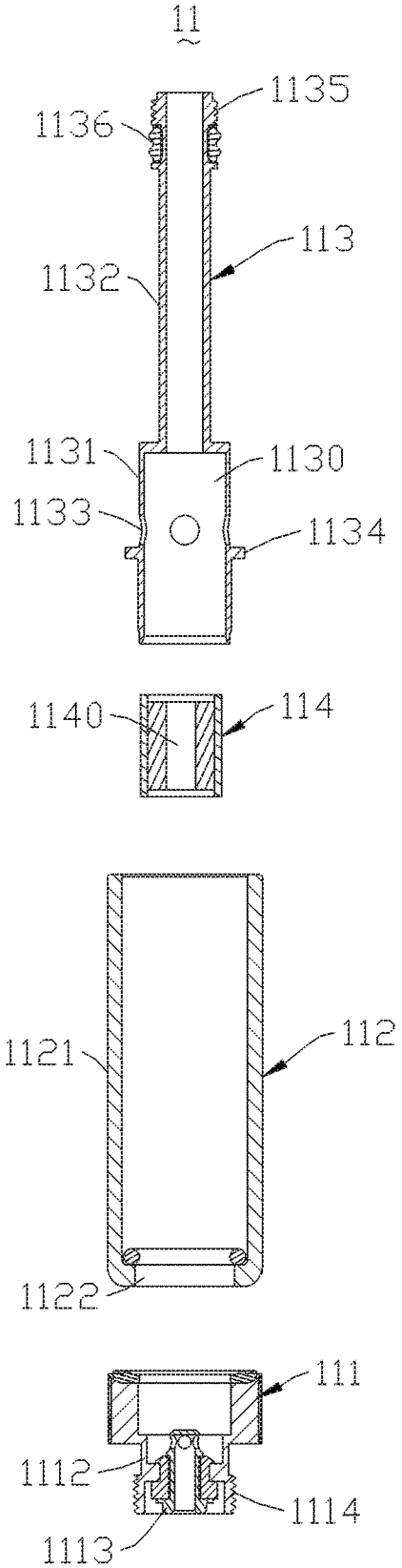
FIG. 6 is a sectional view A-A of the main body unit of the atomizer shown in FIG. 2 in an exploded state.
Figure 7:
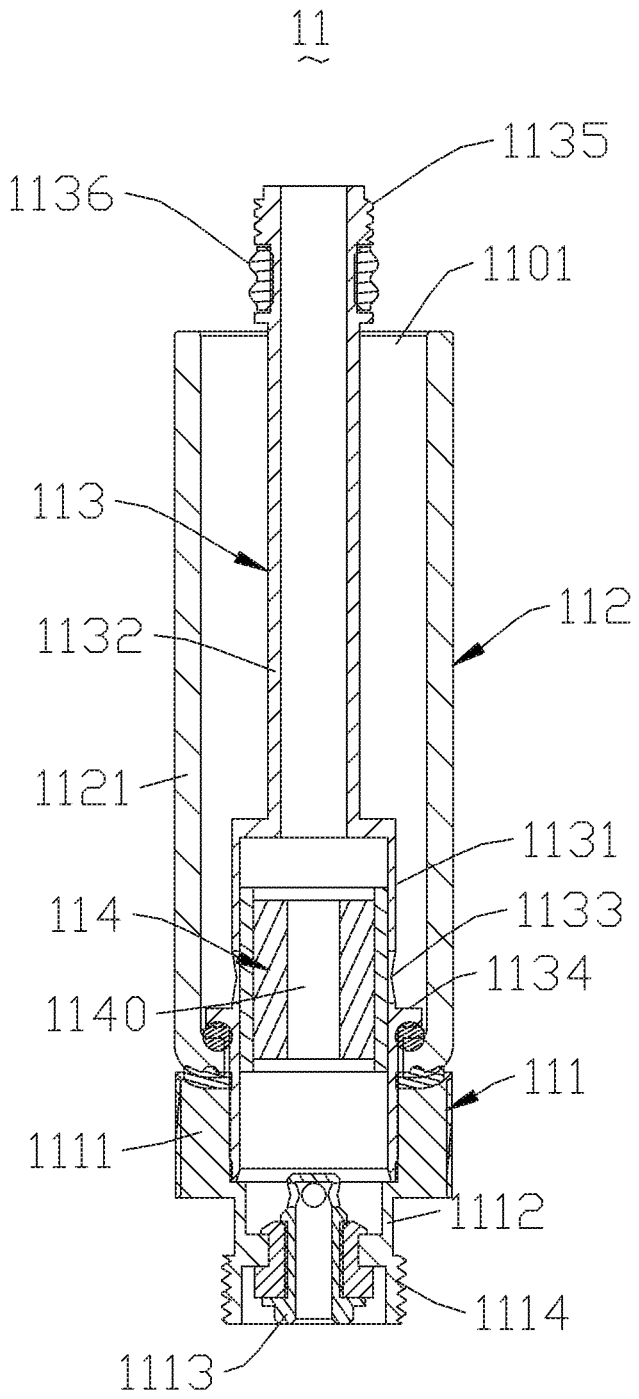
FIG. 7 is a sectional view A-A of the main body unit of the atomizer shown in FIG. 2.

As shown in FIGS. 5 to 7, in some embodiments, the main body unit 11 may include a cylindrical base 111, a cylindrical liquid storage shell 112 with a bottom end thereof disposed on the base 111, a cylindrical first pipe 113 extending in the liquid storage shell 112 and connected to the base 111 via a lower end thereof, and an atomization assembly 114 disposed in the first pipe 113. The base 111 and the lower end of the first pipe 113 clamp a lower end of the liquid storage shell 112 tightly, to fix the liquid storage shell 112 on the base 111. The first pipe 113 and the liquid storage shell 112 define the liquid storage cavity 110 for receiving the liquid medium. The atomization assembly 114 is fluidly connected to the liquid storage cavity 110.

In some embodiments, the base 111 may include a cylindrical body portion 1111, a cylindrical connecting portion 1112 integrally and coaxially connected to a lower end of the body portion 1111, and a positive pole 1113 extending in the connecting portion 1112 in an insulating manner. An outer diameter of the connecting portion 1112 is smaller than that of the body portion 1111, and an outer wall surface of the connecting portion 1112 is provided with a first external thread structure 1114 which is configured to be in threaded connection with the power supply device 20. In some embodiments, the body portion 1111 and the connecting portion 1112 may be made of conductive materials such as aluminum, aluminum alloy or copper, and configured to be electrically connected with a negative electrode of the power supply device 20. The positive pole 1113 is configured to be electrically connected to a positive electrode of the power supply device 20. The connecting portion 1112 may be further provided with an air inlet 1115 to fluidly connect the inside of the base 111 with the outside.

In some embodiments, the liquid storage shell 112 may include a cylindrical shell body 1121 and an annular neck portion 1122 integrally formed at a bottom end of the shell body 1121. A pore diameter of the neck portion 1122 is slightly larger than an outer diameter of an atomization section 1131 of the first pipe 113 and smaller than an outer diameter of a rim 1134 of the first pipe 113. In this way, the atomization section 1131 is able to be inserted into the body portion 1111 of the base 111 through the neck portion 1122, and the rim 1134 is able to abut against an upper surface of the neck portion 1122. A sealing ring (not numbered) is provided between the rim 1134 and the neck portion 1122. The neck portion 1122 is disposed on the body portion 1111 of the base 111, and a sealing ring (not numbered) is provided between the neck portion 1122 and the body portion 1111.

In some embodiments, the first pipe 113 may include an atomization section 1131 with a larger diameter, and a gas guide section 1132 with a smaller diameter and axially connected to an upper end of the atomization section 1131. The atomization section 1131 defines an atomization cavity 1130 for receiving the atomization assembly 114. In some embodiments, the atomization section 1131 further includes a liquid inlet hole 1133 defined on a side wall thereof and a rim 1134 formed in the middle of an outer wall surface thereof and extending radially outward. The liquid inlet hole 1133 fluidly connects the atomization cavity 1130 with the liquid storage cavity 110. The rim 1134 and the base 111 clamp and hold the liquid storage shell 112. The gas guide section 1132 is used to deliver a mixture of the aerosol and air in the atomization cavity 1130 out. An upper end of the gas guide section 1132 protrudes from an upper end of the liquid storage shell 112, and an outer wall surface of the gas guide section 1132 is provided with a second external thread structure 1135 which is configured to be in threaded connection with the suction nozzle unit 12. The gas guide section 1132 is further provided with a sealing ring 1136 adjacent to the second external thread structure 1135 to liquid-seal a joint between the second external thread structure 1135 and the suction nozzle unit 12. An upper end edge of the shell body 1121 and the gas guide section 1132 define the liquid injection port 1101, which is fluidly connected with the liquid storage cavity 110.

The atomization assembly 114 in some embodiments may be cylindrical. The atomization assembly 114 is axially disposed in the atomization cavity 1130 defined by the atomization section 1132 of the first pipe 113, and has an axial through hole 1140 to fluidly connect upper and lower ends of the atomization assembly 114. The atomization assembly 114 corresponds to the liquid inlet hole 1133 of the atomization section 1132, so that the liquid medium in the liquid storage cavity 110 is able to be transferred to the atomization assembly 114 via the liquid inlet hole 1133. Then the liquid medium is heated and atomized by the atomization assembly 114, and the aerosol is delivered into the axial through hole 1140.

It can be understood that when the main body unit 11 is not cylindrical, the shapes of part or all of the base 111, the liquid storage shell 112, the first pipe 113 and the atomization assembly 114 are adaptively changed.

Figure 8:
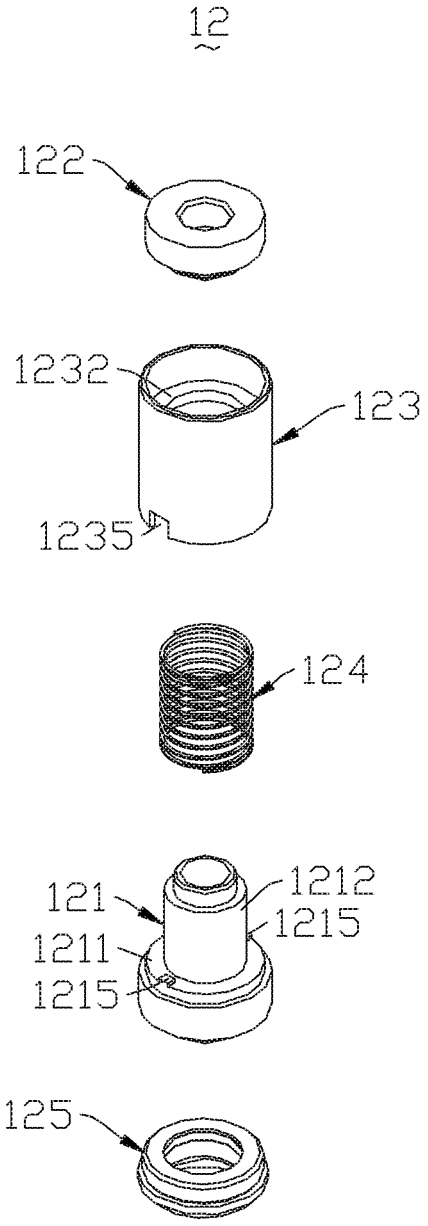
FIG. 8 is a three-dimensional exploded view of a suction nozzle unit of the atomizer shown in FIG. 3.
Figure 9:
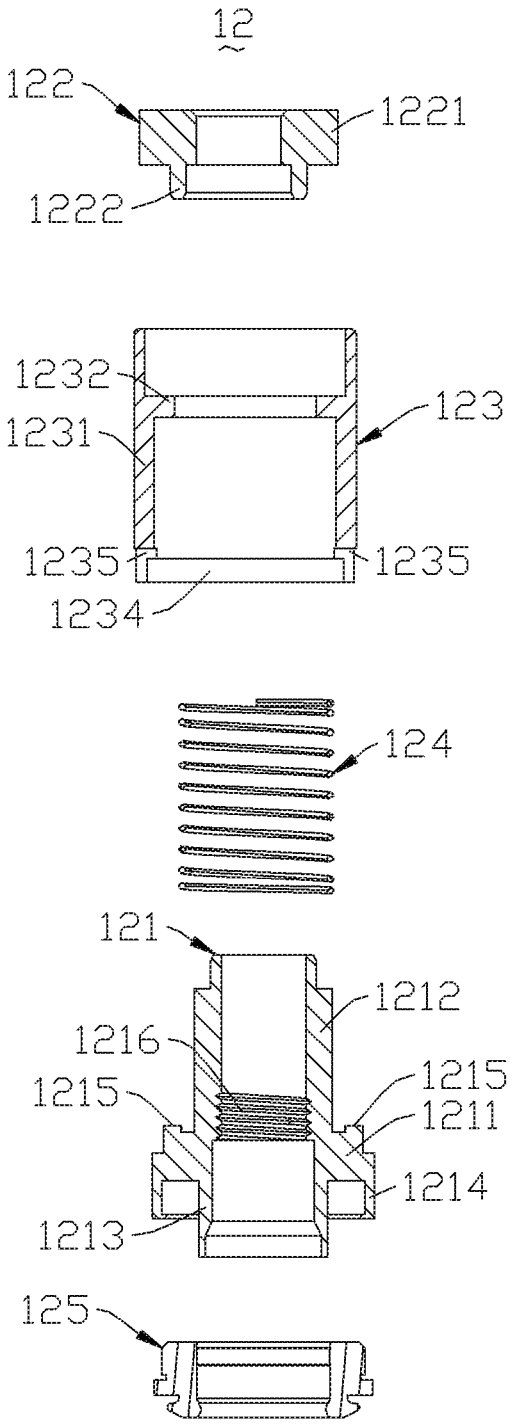
FIG. 9 is a sectional view A-A of the suction nozzle unit of the atomizer shown in FIG. 2 in an exploded state.
Figure 10:
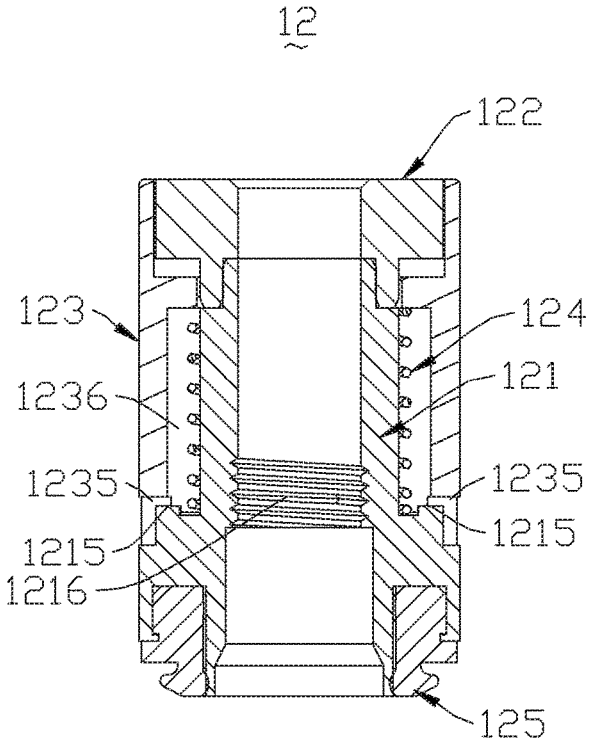
FIG. 10 is a sectional view A-A of the suction nozzle unit of the atomizer shown in FIG. 2.

As shown in FIGS. 8 to 10, in some embodiments, the suction nozzle unit 12 may include a cylindrical second pipe 121, an annular riveting member 122, a cylindrical operating member 123, a cylindrical elastic member 124 and an annular sealing member 125. A lower end of the second pipe 121 is coaxially screwed to an upper end of the first pipe 113 to detachably and fluidly connect the second pipe 121 and the first pipe 113. The riveting member 122 is riveted to an upper end of the second pipe 121 to prevent the operating member 122 from falling off. The operating member 123 is coaxially sleeved outside the second pipe 121, and is able to move axially back and forth relative to the second pipe 121 between a second position away from the lower end of the second pipe 121 and a first position adjacent to the lower end of the second pipe 121, and to rotate around an axis of the second pipe 121. The elastic member 124 is disposed between the second pipe 121 and the operating member 123 to provide an elastic force to maintain the operating member 123 in the second position. The sealing member 125 is disposed at the lower end of the second pipe 121 to seal the liquid injection port 1101 of the liquid storage cavity 110 when the second pipe 121 is screwed to the first pipe 113. The cylindrical second pipe 121, the annular riveting member 122 and the annular sealing member 125 form a main part of the suction nozzle unit 12 to block the liquid injection port 1101 and discharge the aerosol. It can be understood that when the suction nozzle unit 12 is not cylindrical, the shapes of part or all of the second pipe 121, the riveting member 122, the elastic member 124, the operating member 123 and the sealing member 125 are adaptively changed. The operating member 123 is not limited to being cylindrical.

In some embodiments, the second pipe 121 may include a stepped shaft-shaped body portion 1211, an upper pipe section 1212 coaxially disposed in a center of a top surface of the body portion 1211, a lower pipe section 1213 coaxially disposed in a center of a bottom surface of the body portion 1211, and an annular skirt 1214 disposed on a periphery of the bottom surface of the body portion 1211 and protruding downward. A pair of limiting portions 1215 protrudes upward from a top surface, near an edge, of a first shaft section with a smaller diameter. The pair of the limiting portions 1215 are respectively located on two opposite sides of the upper pipe section 1212, for operably cooperating with the operating member 123 to enable the second pipe 121 to rotate with the operating member 123. A pore diameter of the upper pipe section 1213 is smaller than those of the body portion 1211 and the lower pipe section 1213. An inner wall surface of a lower end portion of the upper pipe section 1213 is provided with an internal thread structure 1216, which is configured to be screwed to the second external thread structure 1135 of the first pipe 113. The lower pipe section 1213 is sleeved on an outer periphery of the upper end of the first pipe 113, and together with the upper end of the first pipe 113, defines a space for tightly receiving the sealing ring 1136. In this way, the liquid medium in the liquid storage cavity 110 is prevented from entering a joint between the internal thread structure 1216 and the second external thread structure 1135 via an inner edge of the liquid injection port 1101, thereby preventing the liquid medium from leaking into the second pipe section 121. The skirt 1214 and the lower pipe section 1213 define an annular receiving space 1217 for receiving the sealing member 125.

In some embodiments, the riveting member 122 may include an annular main portion 1221 and an annular riveting portion 1222 extending downward from a bottom surface of the main portion 1221. The riveting portion 1222 can be connected to an upper end of the upper pipe section 1212 of the second pipe 121 by welding or by other means. An outer diameter of the main portion 1221 is larger than an inner diameter of the snap ring 1232 of the operating member 123, so that the snap ring 1232 is prevented from falling off from the upper pipe section 1212.

Figure 11:
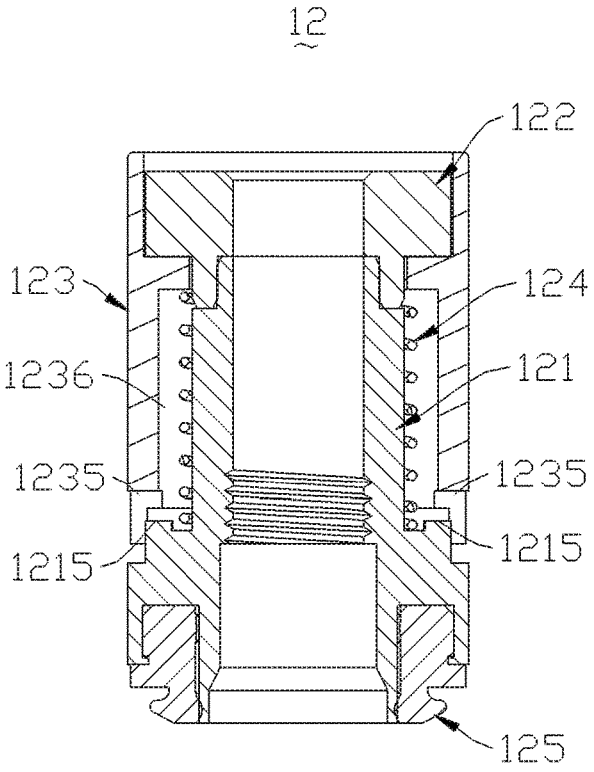
FIG. 11 is a sectional view A-A of the suction nozzle unit of the atomizer shown in FIG. 2 when an operating member is in a second position.

In some embodiments, the operating member 123 may include a cylindrical operating body 1231, a snap ring 1232 disposed on an upper end of the operating body 1231, a cylindrical upper skirt 1233 extending upward from a periphery of an upper end surface of the operating body 1231, a cylindrical lower skirt 1234 extending downward from a periphery of a lower end surface of the operating body 1231, and a pair of clamping slots 1235 extending upwardly from a lower end surface of the lower skirt 1234 to a distance on the operating body 1231. An inner diameter of the operating body 1231 is larger than an outer diameter of the upper pipe section 1212 and smaller than an outer diameter of the first shaft section of the body portion 1211, to define a space 1236 for receiving the elastic member 124. An inner diameter of the snap ring 1232 is slightly larger than an outer diameter of the upper pipe section 1212, so that the snap ring 1232 can be easily sleeved on the upper pipe section 1212, and is axially movable back and forth relative to the upper pipe section 1212 between a second position away from the lower end of the upper pipe section 1212 and a first position adjacent to the lower end of the upper pipe section 1212, and is rotatable around an axis of the upper tube section 1212, thereby enabling the entire operating member 123 to move accordingly. An inner diameter of the upper skirt 1233 is slightly larger than an outer diameter of the main portion 1221 of the riveting member 122, so that the movement of the operating member 123 relative to the second pipe 121 is not interfered by the riveting member 122, and an aesthetic effect is achieved. An inner diameter of the lower skirt 1234 is slightly larger than an outer diameter of a second shaft section (with a larger diameter) of the body portion 1211 of the second pipe 121, so as to shield the second shaft section and achieve an aesthetic effect. When the pair of clamping slots 1235 are respectively aligned with the pair of limiting portions 1215 on the second pipe 121, the lower end surface of the operating body 1231 can be moved down to abut on a top surface of the first shaft section (with a smaller diameter) of the body portion 1211, and the pair of limiting portions 1215 are respectively received in the pair of clamping slots 1235. At this time, when the operating member 123 rotates, side wall surfaces of portions of the clamping slots 1235 on the operating body 1231 abut against side surfaces of the limiting portions 1215. A torsional force applied to the operating member 123 is transmitted to the limiting portions 121 and then to the second pipe 121, so that the second pipe 121 can rotate with the operating member 123. As shown in FIG. 11, when the pair of clamping slots 1235 are not aligned with the pair of limiting portions 1215, or the pair of clamping slots 1235 are aligned with the pair of limiting portions 1215 but not pressed down, the limiting portions 1215 are located below the lower end surface of the operating body 1231. Thus, the operating member 123 can only idle around the axis, failing to transmit the torsional force to the second pipe 121.

In some embodiments, the elastic member 124 may be a cylindrical spring, with an inner diameter slightly larger than an outer diameter of the upper pipe section 1212 of the second pipe 121, so that it can be axially sleeved on the upper pipe section 1212. A lower end of the elastic member 124 abuts against an upper surface of the body portion 1211 of the second pipe 121, and an upper end of the elastic member 124 abuts against a lower surface of the snap ring 1232 of the operating member 123, providing an elastic force to keep the snap ring 1232 abutting against a bottom surface of the riveting member 122. Thus, when there is no external force applied, the operating member 123 is held in the second position, where the operating member 123 idles instead of driving the second pipe 121 to rotate, which increases the difficulty of removing the suction nozzle unit 12 from the main body unit 11.

The sealing member 125 seals the liquid injection port 1101 of the main body unit 11 to prevent the liquid medium from leaking from an outer edge of a joint of the main body unit 11 and the suction nozzle unit 12.

It can be understood that the electronic atomizing device 1 is not limited to a cylindrical shape, and it may alternatively have other shape such as an elliptical cylindrical shape or a rectangular parallelepiped shape. When the electronic atomizing device 1 is in other shape, the shapes of corresponding components are adjusted adaptively.

It can be understood that although the preferred implementations of the present invention are described in detail above, they should not be construed as a limitation to the patent scope of the present invention. It should be noted that for those of ordinary skill in the art the above technical features can be freely combined and several modifications and improvements can be made without departing from the idea of the present invention. However, all equivalent transformations and modifications made within the scope of the claims of the present invention should fall within the scope of the claims of the present invention.

What is claimed is:

1. An atomizer, comprising a main body unit and a suction nozzle unit, wherein the main body unit comprises a liquid storage cavity, an atomization assembly fluidly connected to the liquid storage cavity, and a first pipe fluidly communicated with the atomization assembly;

the liquid storage cavity comprises a liquid injection port fluidly communicating the liquid storage cavity with an outside environment; the suction nozzle unit is detachably disposed on an upper end of the first pipe, and seals the liquid injection port;

the suction nozzle unit comprises a second pipe, an operating member and an elastic member; a lower end of the second pipe is detachably screwed to the upper end of the first pipe and is in fluid communication with the first pipe; the operating member is sleeved on the second pipe, and is axially movable back and forth relative to the second pipe between a first position adjacent to the lower end of the second pipe and a second position away from the lower end of the second pipe, and is rotatable around an axis of the second pipe;

when the operating member is in the first position, the operating member cooperates with the second pipe to enable a torsional force applied to the operating member by an outside to be transmitted to the second pipe;

when the operating member is in the second position, the cooperation between the operating member and the second pipe is released; the elastic member is disposed between the second pipe and the operating member to elastically hold the operating member in the second position.

2. The atomizer according to claim 1, wherein the second pipe is provided with at least one limiting portion, and the operating member is provided with at least one clamping slot corresponding to the at least one limiting portion; when the operating member is in the first position, the at least one clamping slot is engaged with the at least one limiting portion; and when the operating member is in the second position, the engagement between the at least one clamping slot and the at least one limiting portion is released.

3. The atomizer according to claim 2, wherein the second pipe comprises a body portion, and the at least one limiting portion protrudes on a top surface of the body portion near an edge.

4. The atomizer according to claim 3, wherein the operating member comprises a cylindrical operating body; the at least one clamping slot extends a distance upward from a lower end surface of the operating body; when the operating member is in the first position, a side wall surface of the at least one clamping slot corresponds to a side surface of the at least one limiting portion, so that the side wall surface of the at least one clamping slot is able to apply the torsional force to the side surface of the at least one limiting portion when the operating member rotates.

5. The atomizer according to claim 4, wherein the second pipe comprises an upper pipe section disposed on the top surface of the body portion; an outer diameter of the upper pipe section is smaller than a diameter of the top surface of the body portion; the operating member comprises a snap ring disposed on an upper end of the operating body; the snap ring is sleeved on the upper pipe section, is axially movable back and forth relative to the upper pipe section between the first position and the second position, and is rotatable around an axis of the upper pipe section.

6. The atomizer according to claim 5, wherein the elastic member comprises a cylindrical spring; the cylindrical spring is sleeved on the upper pipe section, with one end abutting against a bottom surface of the snap ring and another end abutting against the top surface of the body portion.

7. The atomizer according to claim 1, wherein the second pipe comprises a body portion, a lower pipe section disposed on a bottom surface of the body portion and a skirt disposed on a periphery of the body portion and extending downward; the skirt and the lower pipe section define an annular receiving space; the suction nozzle unit further comprises a sealing member received in the annular receiving space to seal the liquid injection port.

8. The atomizer according to claim 1, wherein the second pipe comprises a body portion and a lower pipe section disposed on a bottom surface of the body portion; the lower pipe section is sleeved on an outer periphery of the upper end of the first pipe, and cooperates with the upper end of the first pipe to define a space for receiving a first sealing ring.

9. The atomizer according to claim 3, wherein the second pipe comprises an upper pipe section disposed on the top surface of the body portion; an inner wall surface of a lower end portion of the upper pipe section is provided with an inner thread structure which is in threaded connection with the upper end of the first pipe.

10. The atomizer according to claim 1, wherein the main body unit comprises a base and a cylindrical liquid storage shell with a bottom end thereof disposed on the base; the first pipe extends in the liquid storage shell, and is connected to the base via a lower end thereof; the base and the lower end of the first pipe clamp a lower end of the liquid storage shell to fix the liquid storage shell on the base; the atomization assembly is disposed in the first pipe; the liquid storage shell and the first pipe define the liquid storage cavity; and the first pipe is provided with a liquid inlet hole for fluidly connecting the atomization assembly to the liquid storage cavity.

11. The atomizer according to claim 10, wherein the upper end of the first pipe protrudes from an upper end of the liquid storage shell, and an outer wall surface of the first pipe is provided with an external thread structure; a second sealing ring is provided at the upper end of the first pipe near the external thread structure.

12. An electronic atomizing device, comprising an atomizer including a main body unit and a suction nozzle unit, wherein the main body unit comprises a liquid storage cavity, an atomization assembly fluidly connected to the liquid storage cavity, and a first pipe fluidly communicated with the atomization assembly;

the liquid storage cavity comprises a liquid injection port fluidly communicating the liquid storage cavity with an outside environment; the suction nozzle unit is detachably disposed on an upper end of the first pipe, and seals the liquid injection port;

the suction nozzle unit comprises a second pipe, an operating member and an elastic member; a lower end of the second pipe is detachably screwed to the upper end of the first pipe and is in fluid communication with the first pipe; the operating member is sleeved on the second pipe, and is axially movable back and forth relative to the second pipe between a first position adjacent to the lower end of the second pipe and a second position away from the lower end of the second pipe, and is rotatable around an axis of the second pipe;

when the operating member is in the first position, the operating member cooperates with the second pipe to enable a torsional force applied to the operating member by an outside to be transmitted to the second pipe;

when the operating member is in the second position, the cooperation between the operating member and the second pipe is released; the elastic member is disposed between the second pipe and the operating member to elastically hold the operating member in the second position.

13. The electronic atomizing device according to claim 12, wherein the second pipe is provided with at least one limiting portion, and the operating member is provided with at least one clamping slot corresponding to the at least one limiting portion; when the operating member is in the first position, the at least one clamping slot is engaged with the at least one limiting portion; and when the operating member is in the second position, the engagement between the at least one clamping slot and the at least one limiting portion is released.

14. The electronic atomizing device according to claim 13, wherein the second pipe comprises a body portion, and the at least one limiting portion protrudes on a top surface of the body portion near an edge.

15. The electronic atomizing device according to claim 14, wherein the operating member comprises a cylindrical operating body; the at least one clamping slot extends a distance upward from a lower end surface of the operating body; when the operating member is in the first position, a side wall surface of the at least one clamping slot corresponds to a side surface of the at least one limiting portion, so that the side wall surface of the at least one clamping slot is able to apply the torsional force to the side surface of the at least one limiting portion when the operating member rotates.

16. The electronic atomizing device according to claim 15, wherein the second pipe comprises an upper pipe section disposed on the top surface of the body portion; an outer diameter of the upper pipe section is smaller than a diameter of the top surface of the body portion; the operating member comprises a snap ring disposed on an upper end of the operating body; the snap ring is sleeved on the upper pipe section, is axially movable back and forth relative to the upper pipe section between the first position and the second position, and is rotatable around an axis of the upper pipe section.

17. The electronic atomizing device according to claim 16, wherein the elastic member comprises a cylindrical spring; the cylindrical spring is sleeved on the upper pipe section, with one end abutting against a bottom surface of the snap ring and another end abutting against the top surface of the body portion.

18. The electronic atomizing device according to claim 12, wherein the second pipe comprises a body portion, a lower pipe section disposed on a bottom surface of the body portion and a skirt disposed on a periphery of the body portion and extending downward; the skirt and the lower pipe section define an annular receiving space; the suction nozzle unit further comprises a sealing member received in the annular receiving space to seal the liquid injection port; the lower pipe section is sleeved on an outer periphery of the upper end of the first pipe, and cooperates with the upper end of the first pipe to define a space for receiving a first sealing ring.

19. The electronic atomizing device according to claim 12, wherein the main body unit comprises a base and a cylindrical liquid storage shell with a bottom end thereof disposed on the base; the first pipe extends in the liquid storage shell, and is connected to the base via a lower end thereof; the base and the lower end of the first pipe clamp a lower end of the liquid storage shell to fix the liquid storage shell on the base; the atomization assembly is disposed in the first pipe; the liquid storage shell and the first pipe define the liquid storage cavity; and the first pipe is provided with a liquid inlet hole for fluidly connecting the atomization assembly to the liquid storage cavity.

20. The electronic atomizing device according to claim 19, wherein the upper end of the first pipe protrudes from an upper end of the liquid storage shell, and an outer wall surface of the first pipe is provided with an external thread structure; a second sealing ring is provided at the upper end of the first pipe near the external thread structure.

* * * * *